US008479721B2

(12) United States Patent
Graham et al.

(10) Patent No.: US 8,479,721 B2
(45) Date of Patent: Jul. 9, 2013

(54) GAS HEATING APPLIANCE

(75) Inventors: Lindsay George Graham, Otago (NZ); Simon Denzil Brown, Dunedin (NZ)

(73) Assignee: Fisher & Paykel Appliances Limited, Auckland (NZ)

( * ) Notice: Subject to any disclaimer, the term of this patent is extended or adjusted under 35 U.S.C. 154(b) by 430 days.

(21) Appl. No.: 11/572,083

(22) PCT Filed: Jul. 13, 2005

(86) PCT No.: PCT/NZ2005/000172

§ 371 (c)(1), (2), (4) Date: Oct. 10, 2007

(87) PCT Pub. No.: WO2006/006882

PCT Pub. Date: Jan. 19, 2006

(65) Prior Publication Data

US 2008/0289617 A1 Nov. 27, 2008

Related U.S. Application Data

(60) Provisional application No. 60/621,001, filed on Oct. 21, 2004.

(30) Foreign Application Priority Data

Jul. 13, 2004 (NZ) ..... 534091

(51) Int. Cl.
*F23D 14/02* (2006.01)

(52) U.S. Cl.
USPC ..... 126/39 E; 126/39 R; 126/1 R; 126/216; 431/10; 431/350; 431/354

(58) Field of Classification Search
USPC ..... 126/15 A, 39 E, 216, 215, 39 R, 126/214 C, 214 D; 431/10, 350, 351, 352, 431/354, 264–266, 258, 181, 187
IPC ..... F23D 14/00,14/02, 14/70
See application file for complete search history.

(56) References Cited

U.S. PATENT DOCUMENTS 1,158,986 A * 11/1915 Cronwall ..... 126/39 R
1,480,944 A 1/1924 Morgan (Continued)

FOREIGN PATENT DOCUMENTS

CN 2451907 Y 10/2001
CN 2604623 Y 2/2004

(Continued)

OTHER PUBLICATIONS

Machine Translation for FR 2701542 Lallement et al.*

(Continued)

*Primary Examiner* — Steven B McAllister
*Assistant Examiner* — Desmond C Peyton
(74) *Attorney, Agent, or Firm* — Clark Hill PLC

(57) ABSTRACT

In one aspect the invention discloses an improved gas burner with a high turn-down ratio. The improved burner includes first and second gas flow passages, a flame front locator in one of the passages of the burner cap. Fuel gas is injected into an end of one of the passages and is ignited to establish a flame at the flame front locator. Secondary combustion air is provided through the other of the passages which on a high setting enables secondary combustion and on a low setting may mix with the hot gases and cool them resulting in a lower temperature at the cooking vessel.

27 Claims, 13 Drawing Sheets

U.S. PATENT DOCUMENTS

| | | | | | |
|---|---|---|---|---|---|
| 2,121,477 | A | * | 6/1938 | Dennis et al. | 126/39 H |
| 2,497,321 | A | * | 2/1950 | Pattinson et al. | 431/172 |
| 2,698,744 | A | * | 1/1955 | Holthouse, Jr. et al. | 261/24 |
| 3,169,573 | A | | 2/1965 | Hidaka | |
| 3,592,180 | A | * | 7/1971 | Kweller et al. | 126/39 H |
| 3,887,134 | A | | 6/1975 | Hacker | |
| 3,940,234 | A | * | 2/1976 | Reed et al. | 431/348 |
| 4,082,497 | A | * | 4/1978 | Crawford et al. | 431/158 |
| 4,383,820 | A | * | 5/1983 | Camacho | 431/8 |
| 4,752,213 | A | * | 6/1988 | Grochowski et al. | 431/328 |
| 4,971,550 | A | * | 11/1990 | Schingnitz et al. | 431/145 |
| 5,009,393 | A | * | 4/1991 | Massey | 251/207 |
| 5,205,727 | A | * | 4/1993 | Aoki et al. | 431/1 |
| 5,391,075 | A | * | 2/1995 | Robinson et al. | 431/258 |
| 5,494,437 | A | | 2/1996 | Kubota et al. | |
| 5,647,739 | A | * | 7/1997 | McDonald | 431/352 |
| 5,819,719 | A | | 10/1998 | Vidal | |
| 5,865,618 | A | * | 2/1999 | Hiebert | 432/222 |
| 6,058,927 | A | | 5/2000 | Maritan et al. | |
| 6,135,764 | A | | 10/2000 | Kwiatek | |
| 6,146,132 | A | * | 11/2000 | Harneit | 431/354 |
| 6,257,228 | B1 | | 7/2001 | Braccini | |
| 6,318,993 | B1 | | 11/2001 | Huang | |
| 6,588,417 | B2 | | 7/2003 | Jones et al. | |
| 6,712,605 | B2 | | 3/2004 | Moresco | |
| 6,834,504 | B2 | * | 12/2004 | Griffin et al. | 60/737 |
| 7,628,609 | B2 | * | 12/2009 | Pryor et al. | 431/286 |
| 7,871,264 | B2 | * | 1/2011 | Pryor et al. | 431/354 |
| 8,057,223 | B2 | * | 11/2011 | Pryor et al. | 431/286 |
| 2003/0129555 | A1 | | 7/2003 | Mukai et al. | |
| 2004/0126727 | A1 | * | 7/2004 | Cho et al. | 431/354 |
| 2010/0051014 | A1 | * | 3/2010 | Pryor et al. | 126/39 E |

FOREIGN PATENT DOCUMENTS

| | | | | |
|---|---|---|---|---|
| EP | 381581 | | | 8/1990 |
| EP | 415008 | | | 3/1991 |
| EP | 0 843 132 | | | 5/1998 |
| FR | 2 701 542 | | | 8/1994 |
| JP | 01310214 | A | * | 12/1989 |
| JP | 03294708 | A | * | 12/1991 |
| JP | 03294709 | A | * | 12/1991 |
| JP | 8247408 | | | 9/1996 |
| JP | 8-303784 | | | 11/1996 |
| JP | 9-310862 | | | 12/1997 |
| JP | 11-51329 | | | 2/1999 |
| JP | 2000-74319 | | | 3/2000 |
| JP | 2000074322 | | | 3/2000 |
| JP | 2000304212 | A | * | 11/2000 |
| JP | 2001324113 | | | 11/2001 |
| JP | 2002-13746 | | | 1/2002 |
| JP | 2004060976 | A | * | 2/2004 |
| WO | 01/33118 | | | 5/2001 |
| WO | 01/50065 | | | 7/2001 |
| WO | 02/066899 | | | 8/2002 |

OTHER PUBLICATIONS

Machine Translation for FR 2701542 Lallement et al., dated Dec. 2009.*

* cited by examiner

GAS HEATING APPLIANCE

This application is a National Phase filing of PCT/NZ2005/000172, having an International filing date of Jul. 13, 2005, which claims priority of NZ534091 having a filing date of Jul. 13, 2004 and U.S. provisional application Ser. No. 60/621,001 having a filing date of Oct. 21, 2004.

FIELD OF THE INVENTION

The invention relates to improvements to gas heating appliances and in particular gas cooktops.

BACKGROUND

There are a number of methods known in the art of providing heat in a cooktop. One preferred method is to use a gas burner which is able to deliver high levels of heating and which responds fairly quickly to desired changes in level. An example of a typical gas burner is described in WO 01/50065. It is typical that the finest level of control will be desired at the lower levels of output range for various cooking duties. In order to achieve good level control, various fuel gas flow control valves have been proposed such as those described in U.S. Pat. No. 5,009,393 and WO 01/33118.

In a typical gas cooktop a trivet is provided to support a cooking vessel above the gas burner and attempts have been made previously to accommodate various shapes of cooking vessels. Examples of trivet arrangements are described in U.S. Pat. No. 6,588,417, WO 02/066899 and U.S. Pat. No. 5,819,719. For gas cooktops, the combustion of fuel gases requires clearance under the cooking vessel to allow flow of the combustion and exhaust gases, which is provided by a trivet to support the cooking vessel the correct distance above the gas flame. A trivet is usually constructed of cast iron or enamel coated steel and comprises a number of narrow prongs to limit interference with the flame and upon which the cooking vessel may rest in a horizontal plane.

Trivets and burner components comprise many complex shapes and surfaces which can make cleaning more difficult. These structures are also visually complex. In order to aid with cleaning, it is known to provide gas heating appliances having removable trivets and removable burner components. However in some cases it may be possible for a user to re-assemble these components incorrectly, which can lead to instability of the cooking vessel and/or incorrect operation of the burner. Incorrect assembly or operation of the gas cooktop components may be hazardous.

Further, various constructions of gas burners and burner rings are also disclosed in the prior art. Prior art burners generally have flame outlet openings which are formed as slots, grooves or bore holes which are generally directed outwardly in approximately a radial direction. Fuel gas is supplied through the burner body and exits through the burner ports where it is combusted forming a ring of flames which are used to heat cooking vessels. The efficiency of conventional gas burners is limited by the need to maintain sufficient clearance around the burner head to allow the flame to draw in enough of the surrounding air to achieve complete combustion of the fuel gas. Due to the clearance between the burner head and the cooking vessel, much of the flame has passed the hottest phase of combustion by the time it contacts the surface of the cooking vessel. Much of the flame heat diffuses into the surrounding mass of flowing gases such that the temperature difference between these flowing gases and the surface of the pot is reduced, which in turn reduces the rate of heat transfer to the cooking vessel.

The operating range of conventional cooktop gas burners is limited to the performance range of the venturi and the burner ports. The venturi uses the velocity of the fuel gas flowing through a small orifice to draw in an approximately proportional volume of air as required for primary combustion. The fixed geometry of the venturi and fuel gas jet limit the range over which this type of burner will operate. Similarly, the range of operation of burner ports is a function of their cross sectional area and the ability of flame to stay attached to the burner port against the flow of the gases when the burner is at the upper end of its operating range. For these prior art burners, burn back velocity and heat transfer between the flame and the burner head provides the lower limit of the operating range of the port structure by extinguishing the flame.

SUMMARY OF THE INVENTION

Accordingly, it is an object of the invention to provide a gas burner with a high turn-down ratio, and/or at least provide the public with a useful choice.

In a first aspect the invention can broadly be said to consist in a gas burner for a cooktop comprising:

a first gases flow passage including an inlet and an outlet, a second gases flow passage including an inlet and an outlet, at least one fuel gas jet configured to supply fuel to said second gases flow passage, a source of oxidizing gases at said inlet of said first gases flow passage, a source of oxidizing gases at said inlet of said second gases flow passage, a flame locator within said second gases flow passage, and spaced upstream from said outlet of said second gases flow passage, and spaced downstream of said inlet of said second passage, said spacing upstream from said outlet of said second passage sufficient to shelter a flame, when said burner is at a low power setting, from said oxidizing gases in said first passage, said outlet of said first gases flow passage proximate to said outlet of said second gases flow passage, and a burner cap spaced downstream from said outlet of said second gases flow passage, said burner cap extending transversely to the outlet direction of said second gases flow passage.

Preferably said inlet of said first gases flow passage and said inlet of said second flow passage are in fluid communication with at least one pressurised pressurized gases supply.

Preferably the minority majority of pressurized gases from said pressurized gases supply flows through said first second gases flow passage.

Preferably said pressurized gases supply is provided by at least one constant speed fan.

Preferably said pressurized gases supply is at least one variable speed fan.

Preferably said burner includes a plenum chamber receiving air from said pressurized gases supply and a burner body having at least an annular end portion projecting into said plenum chamber with an annular air inlet receiving air from said plenum chamber, said burner body being divided into said first gases passage way and said second gases passage way.

Preferably said body is divided by a vertically oriented cylindrical tube mounted concentrically within said body, with a lower open end of the tube spaced from the floor of said chamber above said fuel jet.

Preferably said outlet of said second flow passage is located substantially within said first passage and said outlet of said second passage is in fluid communication with said outlet of said first passage.

Preferably said fuel gas jet is spaced from said inlet of said second gases passage, and said jet is in fluid communication with said inlet of said second passage.

Preferably said first passage is partially closed, at an inlet end, and said inlet said first passage comprises of a plurality of apertures at said inlet end of said first passage.

Preferably said apertures are radially spaced slots extending axially with respect to said first passage.

Preferably said second flow passage is located concentrically within said first flow passage.

Preferably said burner cap is movable, having a first extended operating condition and a second, retracted non-operating condition, said cap extending transverse to said outlet of said first flow passage.

Preferably with said cap in said first extended operating condition, said cap is spaced from said outlet of said first flow passage, and in said second retracted non-operating condition said cap substantially closes said outlet of said first flow passage.

Preferably said burner is located in a horizontal cooking surface having at least one aperture, and said burner cap fits said aperture in said cooking surface and is movable between a position wherein the top surface of said cap is at least substantially flush with said cooking surface and a position wherein said cap is displaced from said cooking surface to leave an annular opening to said outlet of said first flow passage.

In a further aspect the invention can broadly be said to consist in a gas burner for a cooktop comprising:

a first gases flow passage including an inlet and an outlet, a second gases flow passage substantially concentric with said first gases flow passage and having an inlet and an outlet, at least one fuel gas supply injecting fuel gas at a controlled rate to flow through said second gases flow passage, said inlet of said first gases flow passage and said inlet of said second gases flow passage being in fluid communication with a pressurized gases supply, a flame front locator within said second gases flow passage and spaced upstream from said outlet of said second gases flow passage so that said fuel gas when ignited forming a flame within said second gases flow passage, said flame when said burner is in a low power setting extending downstream toward said outlet of said second gases flow passage and being substantially within said second gases flow passage, and said flame when said burner is in a high power setting extending downstream through said outlet of said second gases flow passage and beyond said outlet of said first gases flow passage, and a burner cap spaced downstream from said outlet of said second gases flow passage, said burner cap extending transverse to said downstream direction.

Preferably the majority of pressurized gases from said pressurized gases supply flows through said first gases flow passage.

Preferably said pressurized gases supply is provided by at least one constant speed fan.

Preferably said pressurized gases supply is a variable speed fan.

Preferably said burner includes a plenum chamber receiving air from said pressurized gases supply and a burner body having at least an annular end portion projecting into said plenum chamber with an annular air inlet receiving air from said plenum chamber, said burner body being divided into said first gases passage way and said second gases passage way.

Preferably said body is divided by a vertically oriented cylindrical tube mounted concentrically within said body, with a lower open end of the tube spaced from the floor of said chamber above said fuel jet.

Preferably said flame locator in said second flow passage locates a base of said flame proximate a downstream side of the flame locator means.

Preferably said burner further comprises means for igniting said fuel gas in said second flow passage, downstream of said flame locator means.

Preferably said burner in a said low power setting, complete combustion or near complete combustion of said fuel gas is achieved before said flame substantially exits said outlet of said first flow passage.

Preferably with said burner in a said low power setting, said fuel gas is at least substantially entirely burnt in the gases flow through said second flow passage, and the second flow passage gases mix with air flowing through said first flow passage in exiting said burner.

Preferably with said burner cap in a said high power setting, combustion of said fuel gas is partially complete in said gases flowing through said second flow passage, and said second passage gases including incompletely combusted fuel gas mix with air flowing through said first flow passage, such that secondary combustion occurs in the vicinity of a lower peripheral edge of said burner cap, releasing further energy and substantially completely combusting said fuel gas.

Preferably said outlet of said second flow passage is located within said first passage and said outlet of said second passage is in fluid communication with said outlet of said first passage.

Preferably said fuel gas supply is injected through a fuel gas nozzle spaced from said inlet of said second gases passage and said injector is in fluid communication with said inlet of said second passage.

Preferably said first passage is partially closed, at an inlet end and said inlet of said first passage comprises a plurality of apertures toward said inlet end of said first passage.

Preferably said apertures are radially spaced slots extending axially with respect to said first passage.

Preferably said burner cap is located in a substantially horizontal cooktop surface having at least one aperture and said burner cap substantially fits said aperture in said cooktop surface and is movable between a position wherein the top surface of said cap is at least substantially flush with said cooktop surface and a position wherein said surface of said cap is displaced from said cooktop surface.

A domestic gas heating appliance comprising a planar cooking surface, a user interface, and at least one burner. The burner comprises a first gases flow passage including an inlet and an outlet, a second gases flow passage including an inlet and an outlet, at least one fuel gas jet configured to supply fuel to said second gases flow passage, a flame front locator within said second gases flow passage, and spaced upstream from said outlet of said second gases flow passage, a source of oxidizing gases at said inlet of said first gases flow passage, a source of oxidizing gases at said inlet of said second gases flow passage, and said outlet of said first gases flow passage proximate to said outlet of said second gases flow passage, and a burner cap spaced downstream from said outlet of said second gases flow passage, said burner cap extending transversely to said outlet of said second gases flow passage.

A domestic gas heating appliance, comprising a substantially planar cooking surface, a user interface, at least one burner. The burner comprises a first gases flow passage including an inlet and an outlet, a second gases flow passage substantially concentric with said first gases flow passage and having an inlet and an outlet, at least one fuel gas supply injecting fuel gas at a controlled rate to flow through said second gases flow passage, said inlet of said first gases flow passage and said inlet of said second gases flow passage being in fluid communication with a pressurized gases supply, a flame front locator within said second gases flow passage and spaced upstream from said outlet of said second gases flow passage so that said fuel gas when ignited forming a flame within said second gases flow passage, said flame when said burner is in a low power setting extending downstream toward said outlet of said second gases flow passage and being substantially within said second gases flow passage, and said flame when said burner is in a high power setting extending downstream through said outlet of said second gases flow passage and beyond said outlet of said first gases flow passage, and a burner cap spaced downstream from said outlet of said second gases flow passage, said burner cap extending transverse to said downstream direction.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

Embodiments of the invention will now be described, by way of example only, with reference to the drawings in which.

DETAILED DESCRIPTION

Throughout the description reference is made to the accompanying Figures which are labelled with numerals in order to more clearly describe the invention. A number of different embodiments are described and illustrated, representing various combinations of features. Where possible, like elements have been used across different embodiments to illustrate similar or shared components.

In one aspect the present invention provides an easily cleaned gas cooktop surface. The surface is not cluttered by a traditional trivet and can thereby be used for other purposes when not in use for cooking. The cooktop surface is preferably substantially planar but may include raised regions (especially around apertures in the cooktop surface) to contain spillage of food or liquids on the spill plane of the cooktop in order to reduce the potential for spillages to leak into the appliance. It will be readily appreciated that cooktop surfaces usually include multiple burners, which may be of various sizes, types and/or configurations. Such configurations are to be understood as being within the scope of the present invention. The description and Figures following, describe a gas heating appliance having a cooktop surface with a single gas burner, by way of illustration only. In practice multiple burner and support assemblies may be included in a single cooktop assembly, in any desired arrangement.

Figure 1:
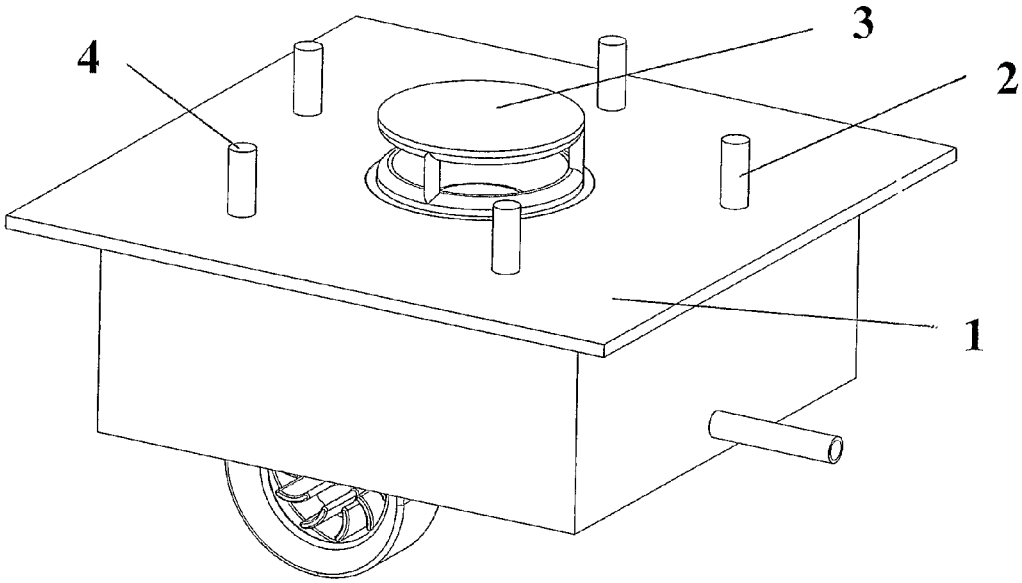
FIG. 1 is a perspective view of a cooktop of a gas heating appliance according to an embodiment of the present invention showing the cooking vessel supports and burner cap extended.

With reference to FIG. 1, the cooktop consists of a planar cooktop surface 1, with a plurality of cooking vessel supports 2 and burner cap 3 protruding from the surface in a first operating condition. The cooking vessel supports 2 are preferably regularly spaced around burner cap 3 on one or more pitch circles. In order to provide stable support for the cooking vessel, there are preferably at least three spaced support points for contacting the cooking vessel. In one preferred embodiment, five support locations 4 are provided each by an individual cooking vessel support 2. The supports 2 extend upwards in a direction substantially normal to planar cooktop surface or spill plane 1. The extended cooking vessel supports 2 are adapted to support a cooking vessel at an appropriate distance above the burner cap 3. It will be appreciated that the vessel supports 2, are inherently suitable for providing stable support to a cooking vessel having a curved or partially curved bottom such as a wok as well as conventional flat bottomed vessels such as pots pans and griddles. At least part of the upper surface of burner cap 3 may also be operable to provide additional support for the cooking vessel.

Figure 2:
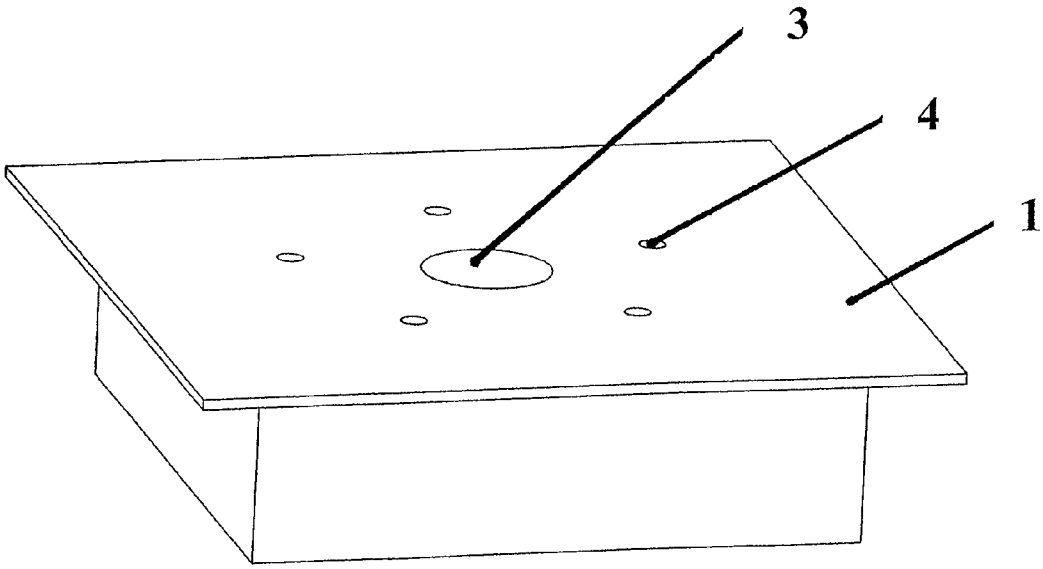
FIG. 2 is a perspective view of the cooktop of FIG. 1 showing the gas burner head and cooking vessel supports retracted.
Figure 3:
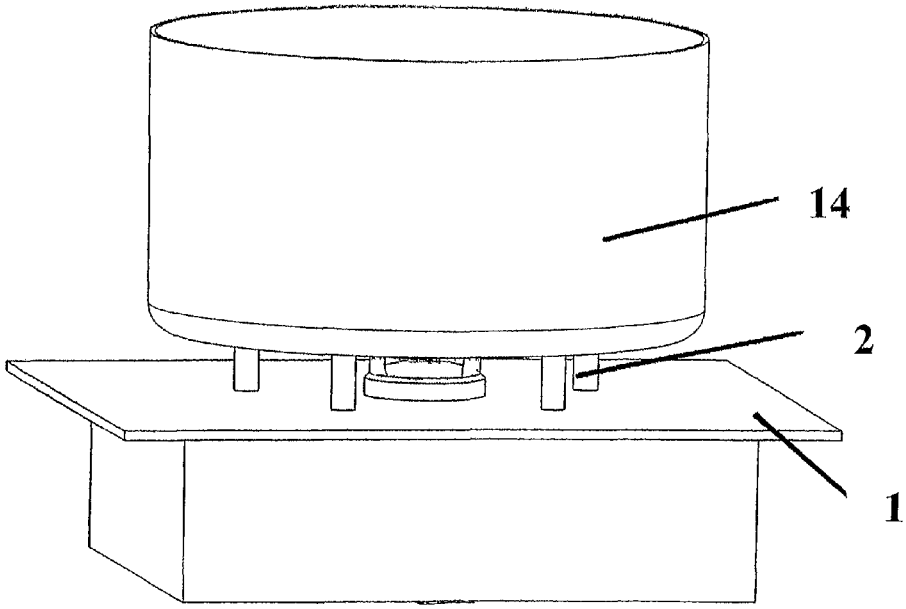
FIG. 3 is a perspective view of the gas heating appliance of FIGS. 1 and 2, showing a cooking vessel supported in use on the appliance.

FIG. 2 shows the cooktop of the gas heating appliance in a second operating condition, wherein the cooking vessel supports 2, and burner cap 3, are retracted so that they are substantially flush with the cooktop surface 1. In this position, when the burner is not being used, the substantially flat planar surface is easy to clean and not visually complex. The retracting burner and cooking vessel supports also allow the cooktop surface to be used as a flat bench top when the burner is not in use. The cooktop surface or burner cap may also include a lip around the burner orifice to prevent spills entering and therefore may be only substantially flat and not perfectly planar. In the case where an upper support surface of the burner cap 3 contacts the vessel 14, to provide additional support to the vessel, it is important that the vessel is supported the appropriate distance from the flame in order to allow efficient heating. The relative sizes of components and the distances of the flame from the support surfaces will depend on the type of gas burner, and intended use.

Preferably the retracting/extending mechanism is automatically driven from below the cooktop surface of the appliance, by a mechanical lifting mechanism including an actuator. Alternatively, the actuator for retracting and/or extending the lifting mechanism of the burner cap and/or cooking vessel supports may be electro-mechanical, hydraulic, pneumatic or operated manually. In the preferred embodiment both the cooking vessel supports 2 and the burner cap 3, retract and extend, so that the cooktop surface is completely flat or substantially flat when retracted. Alternatively, only the burner cap 3 or only the trivet supports 2 may be actuable to retract and extend.

It may be desirable to provide the gas appliance with gas controls located on or in the cooktop surface 1, which are also actuable to retract and extend relative to the planar cooktop surface 1. Embodiments wherein all of the moveable components (cooking vessel supports 2, the burner cap 3 or gas controls (not shown)), retract so as to be substantially flush with the planar cooktop surface 1, result in a cooktop surface which is substantially planar and can be cleaned by wiping down, just as a flat bench top would be. Alternatively, the gas controls may be provided on a surface other than the cooktop surface, for example on a bench top fascia or may be provided as electronic touch controls which are flush to the cooktop surface. Where the gas controls are moveable, it is envisaged that the lifting mechanism of the burner components may also be used to lift the associated gas controls. Alternatively, the lifting of each burner control may be independent from the burner controls, and may utilize independent lifting mechanisms from the burner components.

Figure 19:
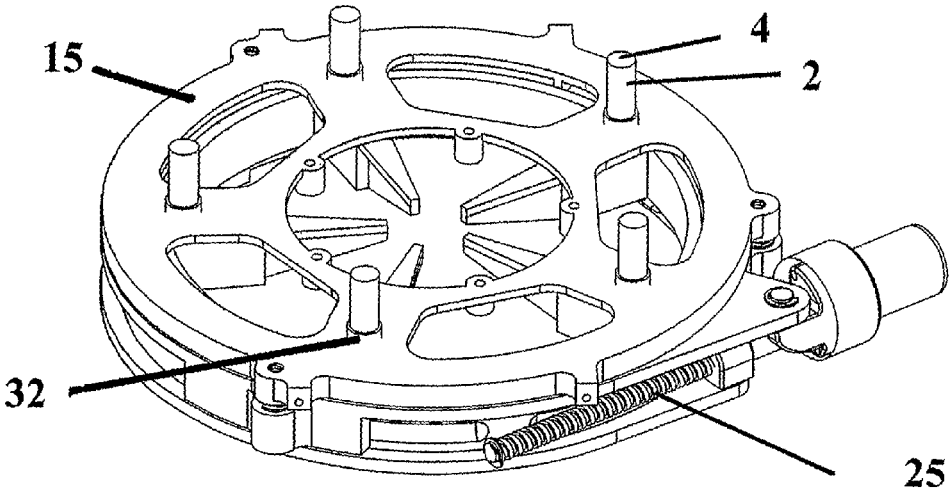
FIG. 19 is a perspective view of a lifting mechanism according to an embodiment of the present invention shown in FIG. 6.

In order to aid with cleaning the planar cooktop surface 1 when the burner cap 3 and cooking vessel supports 2 are retracted, the clearance between the retracting/extending elements and the apertures in the cooktop surface which receive them, is preferably as small as practicable. A relatively tight fit between the retracting/extending members and the apertures in the cooktop surface is preferable to minimize the gaps in which food and/or spillages may become trapped and difficult to wipe clean. Bushes may be provided between the cooktop surface and the moveable elements to aid the movement as the components extend and retract. Referring to FIG. 19, bushes 32 may also be preferable in order to improve sealing between the vessel supports and cooktop surface. Alternatively a "chassis" in the form of a sheet metal plate may be glued to the underside of the glass cooktop surface 1. This plate includes threaded inserts to which the lifter mechanism and burners (such as shown in FIGS. 7-12) can be mounted. The bushes in this case may include a flange that is trapped between the glass cooktop surface and the plate to provide a bearing surface extending through the apertures in the cooktop.

There are many options suitable for initiating or triggering the extension and/or retraction of the moveable elements of the cooktop of the present invention. Further, it will be appreciated that many of these options are suitable to be employed individually and/or in combination to achieve different desirable effects. For example, the raising of the pot supports and/or gas burners (and/or controls) may be triggered by an electronic touch control or switch, or by the first action of a gas control knob. Where the gas controls are also retractable, electronic touch controls may be used for at least the first stage of operation i.e. raising the gas controls. Further, the retraction of the pot supports 2 (when switched off) may be activated by the last action of the gas control knob or via an electronic touch control or switch. It is envisaged that the gas burners may be fitted with an automatic igniter such as hot surface igniter or spark igniter as is well known in the art. It is envisaged that the automatic start may be configured to ignite the burner automatically once the burner cap and pot supports are extended. In order to achieve this, a time delay or a limit switch may be utilized. Alternatively, the igniter may be operated manually as is well known in the art. Further, it is envisaged that a flame detection means may also be incorporated into the cooktop to make sure that unburnt gases do not escape and endanger the user if the flame is extinguished. Flame supervision methods to operate auto reignition and safety shut off functions may be incorporated into the cooktop via flame rectification and/or thermocouples which are well established methods in the art.

The retraction and/or extension of the pot supports, burner cap(s) and/or the gas control knob(s) may also incorporate a time delay where appropriate, so that the various steps occur in a pre-defined sequence. For example, after the cooktop burner is extinguished, the gas burner cap and/or cooking vessel supports and/or gas controls may remain extended for a time period to allow cooling. It is envisaged that the time period may be controlled by temperature sensors or alternatively may be a predetermined or calculated time. The cooktop may also include a sensor in order to determine if a cooking vessel is positioned on the vessel supports over a burner so that retraction and/or extension of the vessel supports 2 may be conditional on the presence or absence of a cooking vessel. The cooking vessel proximity sensors may function in a number of ways, for example, they may sense force or be activated by force applied by the weight of the cooking vessel on the lifting mechanism or alternatively may operate via electrical contact points which utilize the cooking vessel to complete a circuit. Alternatively, induction may be used to sense the presence or absence of a cooking vessel. The cooking vessel proximity sensors may also include an override in order to accommodate unusual cooking situations where this feature may not be desirable for any reason.

It is envisaged that gas appliances having multiple burners in the cooktop surface for multiple cooking vessels may be operated together, or separately, or in subgroups. Each of the burners, vessel supports, and/or controls may be extendable/retractable independently or in combination with each of the other burners.

The gas heating appliance may include a controller controlling the supply of power to said actuator, and a user interface for operating the appliance. The controller receives input from the user interface and controls the supply of power to the actuator as a function of at least one of:

(a) inputs from the interface, (b) feedback from the actuator, and (c) signals derived from the vessel supports.

For example the controller may drive the actuator to raise the vessel supports in response to a user operating the user interface to indicate activation of a burner. Or the controller could cause the actuator to raise the supports on detecting contact of a conductive surface across a plurality of said support locations, and/or lower said supports following removal of such a conducting surface from said support locations, for example after a predetermined delay, or after the controller has determined, by sensing estimation, that the supports have cooled to a touch safe temperature. Furthermore the controller may operate the actuator between physically fixed upper and lower limits and remove power upon detecting the actuator reaching those limits.

Figure 4:
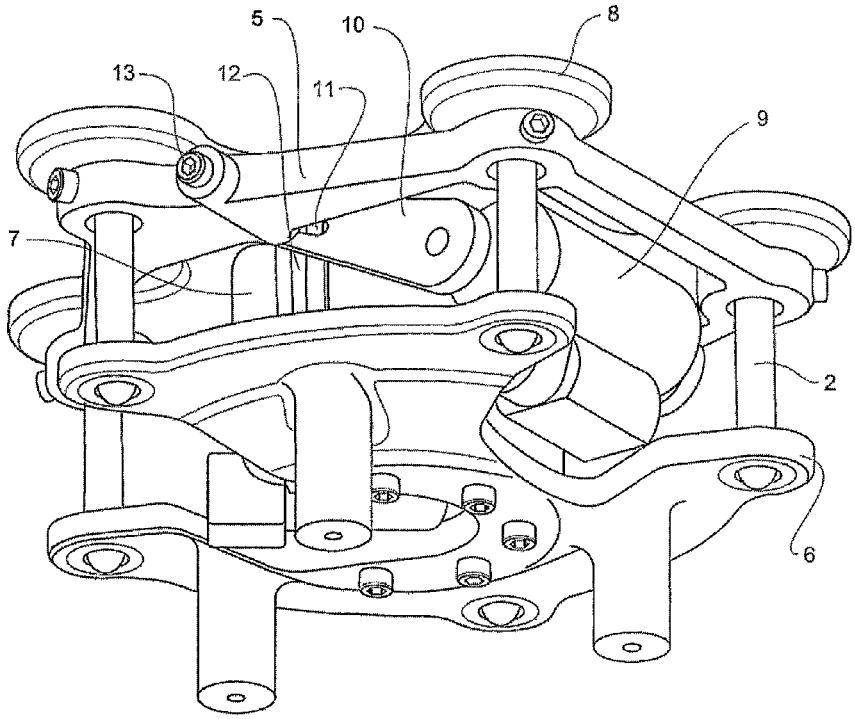
FIG. 4 is a perspective view of the underside of a cooktop according to an embodiment of the present invention shown with the cooking vessel supports extended, by a lever lifting mechanism.
Figure 5:
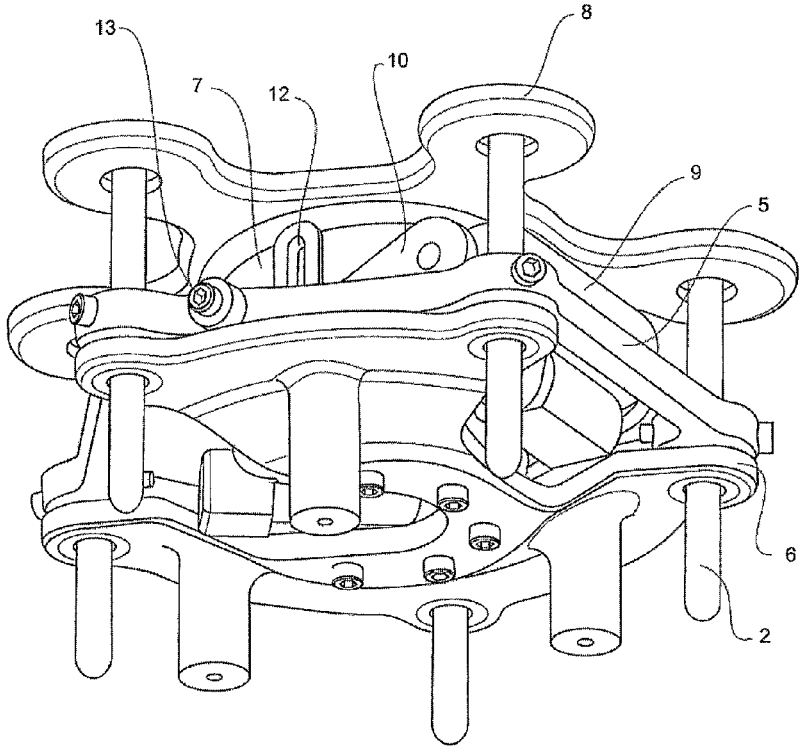
FIG. 5 is a perspective view of the underside of the cooktop of FIG. 4 shown with the cooking vessel supports retracted.

FIGS. 4 and 5 show the underside of the gas cooktop where a retracting/extending mechanism can be seen. The cooktop includes five cooking vessel supports 2, arranged on a single pitch circle. Cooking vessel supports 2 are fixed to a support frame 5 which constrains all of the cooking vessel supports 2 to move together. Movement of these cooking vessel supports 2, in unison, is desirable so that the cooking vessel cannot be tilted or supported unevenly. The cooking vessel supports have a first extended operating condition and a second retracted operating condition as previously described. Guide frame 6 is provided mounted to the under body of the gas burner housing 7. The cooking vessel supports 2 are constrained from movement other than along their main axis, by cooktop aperture guides 8 and the guide frame 6. These guides may include temperature resistant bushes. Movement of the cooking vessel supports 2 in their axial direction is achieved by movement of the support frame 5 relative to the cooktop surface 1. FIG. 4 shows support frame 5 in its upper position which corresponds to the cooking vessel supports extended position, substantially as shown in FIG. 1. FIG. 5 shows the support frame 5 in its lower position which corresponds to the retracted position of the cooking vessel supports 2, substantially as shown in FIG. 2. When in their retracted position, the lower ends of cooking vessel supports 2 project downwards from the guide frame 6. A servo motor 9 is provided with levers 10 rigidly fixed to either side of its shaft for moving the vessel supports 2 between their operating conditions (only one side shown). Actuation of the servo motor 9, rotates the lever 10, which is coupled to the support frame 5 via a pin 13 engaged within a slot 11 on the lever 10. Rotation of lever 10, moves the support frame 5 and its associated vessel supports 2 along their axes between their first and second operating conditions. Pin 13 is further engaged in vertical slot 12 in the gas burner housing 7. Slot 12 extends parallel to the axis of the cooking vessel supports 2 and constrains the support frame 5 and vessel supports 2 to vertical motion. This lifting mechanism allows the rotation of the servo motor shaft to retract and extend the cooking vessel supports 2, via the rotation of the slotted lever 10.

Alternatively, it is envisaged that each of the vessel supports 2 may be actuated independently via a simple linear actuator. Preferably such an actuator would also include a failsafe to prevent collapse and/or tipping of the vessel supports in the event of a fault condition, in one or more vessel supports 2.

An alternative preferred method of driving the vessel supports and/or burner cap 3 and/or burner controls will now be described with reference to FIGS. 7 to 12. The ball cam lifting mechanism of a preferred embodiment includes of a stationary support ring 19 mounted underneath the cooktop surface of the gas heating appliance. A rotating support ring 20 is mounted inside the stationary support ring 19 and surrounds a cooking vessel support mounting ring 21. The three rings 19, 20 and 21 are interconnected by three sets of three ball bearings which run in respective slots between the interconnected rings to constrain their respective relative movements. A lead screw and actuator 22 is connected between stationary support ring 19 and rotating support ring 20 through pin joins 23 and 24.

Movement of the lead screw 25 drives rotation of the rotating support ring 20 with respect to the stationary support ring 19. This motion is constrained by a ball bearing acting in each of three pairs of cooperating slots 26,29. In turn, rotation of the rotating support ring 20 results in translation of the cooking vessel support mounting ring 21 along its axis (vertically) via interaction with a ball bearing engaged in each of three respective pairs of angled slots 33,34 in the mounting ring 21 and rotating support ring 20 respectively. Rotation of the rotating support ring 20 via lead screw actuator 22, enables the cooking vessel support mounting ring 21 which includes a plurality of cooking vessel supports 2 to extend and retract the cooking vessel supports 2 with respect to the cook top surface 1.

Figure 7:
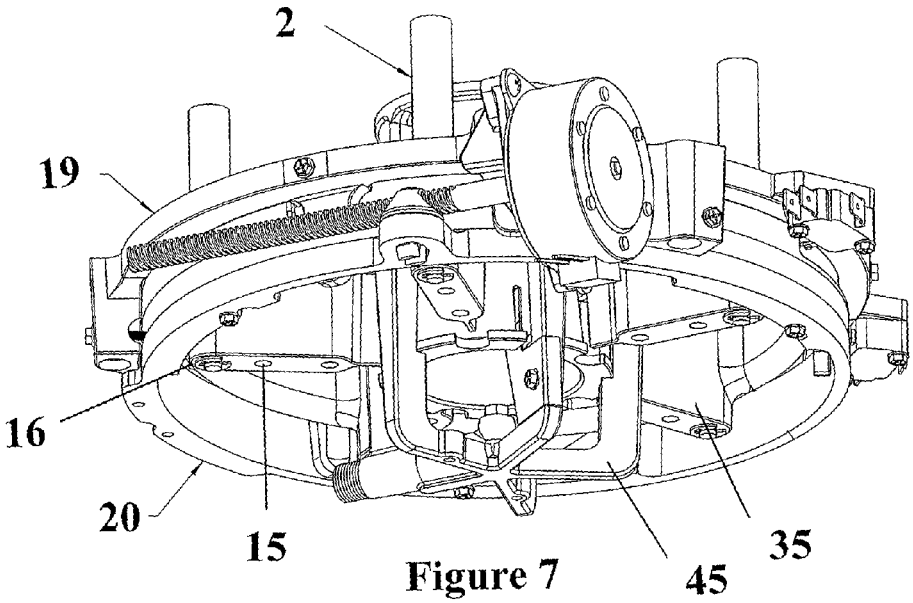
FIG. 7 is a perspective view of the under side of a ball cam lifting mechanism according to a further embodiment, shown with the cooking vessel supports extended.
Figure 11:
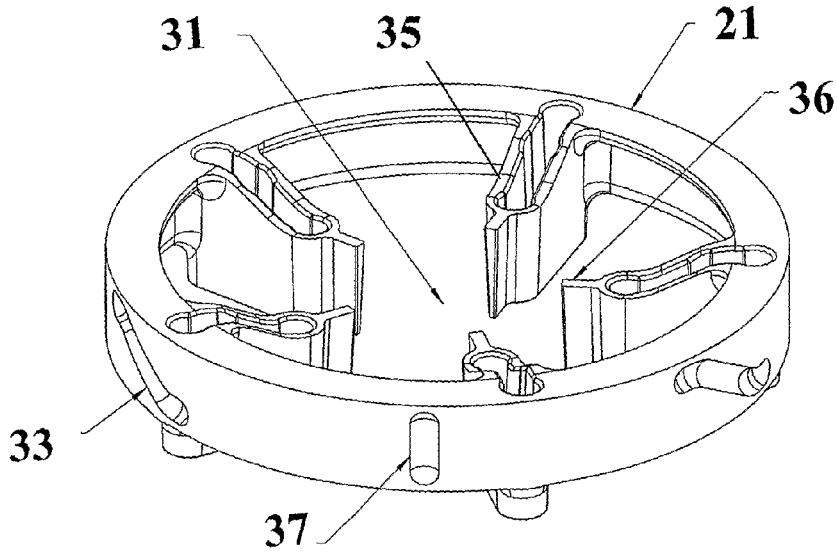
FIG. 11 is a perspective view of the cooking vessel support mounting ring of the mechanism shown in FIGS. 7 and 8.
Figure 12:
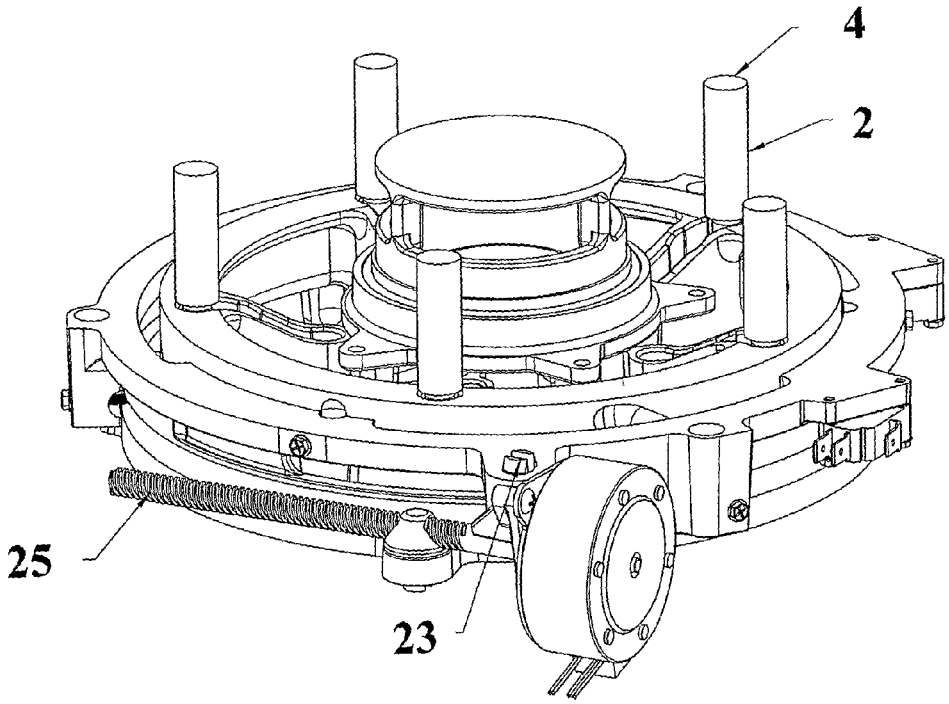
FIG. 12 is a perspective view of the top side of the ball earn lifting mechanism of FIGS. 7 and 8, showing the cooking vessel supports and a burner cap extended.

With reference to FIG. 11, cooking vessel support mounting ring 21 includes five (one for each cooking vessel support 2) radially inwardly extending fingers 35. Each inwardly extending finger 35 is adapted to receive at least one cooking vessel support (not shown in FIG. 11). With reference to FIG. 7, it can be seen that each of the extending fingers 35 includes three holes 15 suitable for mounting cooking vessel supports 2 in order to accommodate varying pitch circles which may be desirable for cooking vessels of varying sizes allowing the mechanism to be used in relation to burners of different capacity. Vessel supports 2, are secured in position by a circlip 16. Alternatively, other suitable removable or permanent fastening car be used such as threading, swaging, welding, press-fitting or clipping. For example, a socket fitting screwed into a thread on the lifting mechanism could be used which receives a ball end on the respective pot support 2. This releasable ball and socket mechanism allows the coupling to pull apart if the pin 2 becomes stuck. In such a case, the stuck support would remain up (extended) and can then be pulled out from above, cleaned and reinserted into the socket. The socket may also be screwed in and/or out further to allow small adjustments of the height of individual pot supports.

The inner ends 36 of fingers 35, extend toward the center of the mounting ring 21. The ends 36 are adapted to engage with the burner of the heating appliance such that the burner cap 3 may also be extendable and retractable (as previously described) via the ball earn lifting mechanism. For example, the ends 36 may extend through the slots in the burner housing to support a lower edge of the burner cap. The size of the central gap 31 at the ends of the fingers 35, in the middle of the mounting rings 21, can be varied according to the size of the burner cap utilized. For manufacturing purposes, it may be desirable to manufacture one size mounting ring 21, and machine out the ends of fingers 36 to accommodate larger burner caps.

Figure 9:
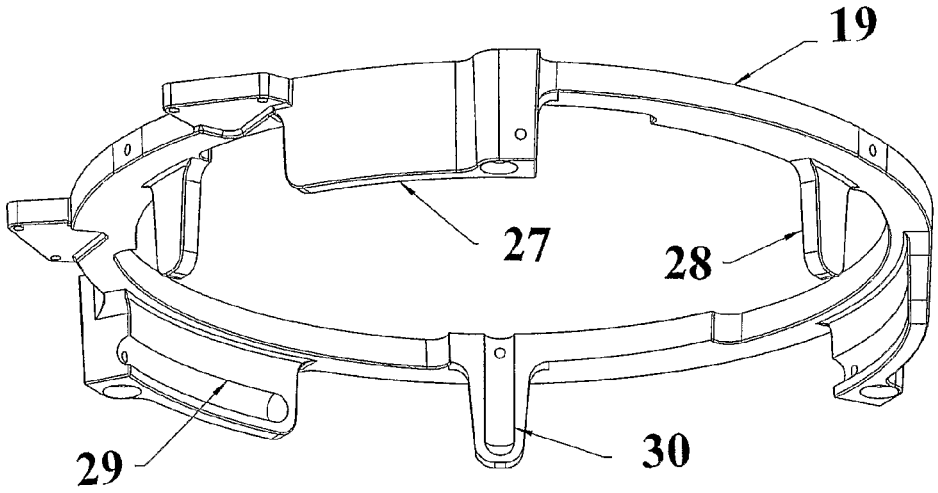
FIG. 9 is a perspective view of the stationary support ring of the mechanism shown in FIGS. 7 and 8.
Figure 10:
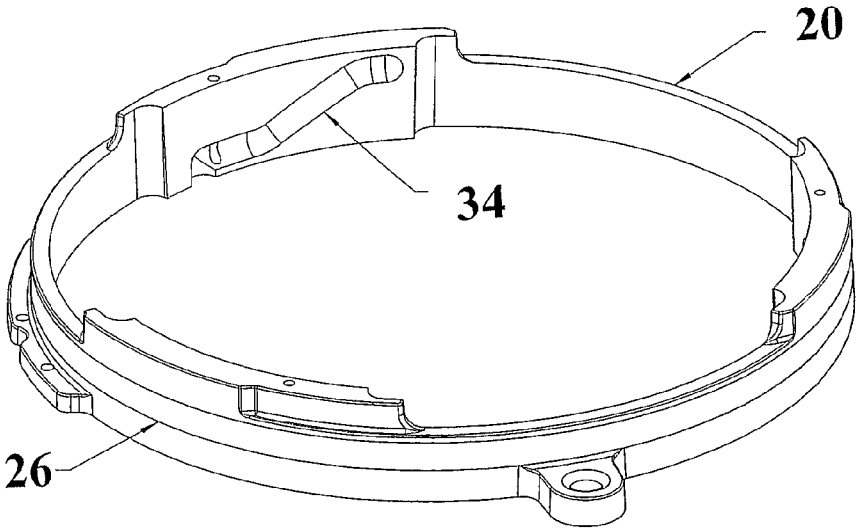
FIG. 10 is a perspective view of the rotating support ring of the mechanism shown in FIGS. 7 and 8.

Mounting ring 21, also includes three angled slots 33 located at regularly spaced intervals on the outer surface of the mounting ring 21. Three equally spaced vertical slots 37 are also located in the outer surface of mounting ring 21 between angled slots 33. With reference to FIG. 10, the inner surface of rotating support ring 20 includes three regularly spaced angled slots 34 which correspond to the shape of the three angled slots 33 on mounting ring 21. Rotating support ring 20, further includes circumferential slot 26. With reference to FIG. 9, support ring 19 includes regularly spaced downwardly projecting portions 27 which have inwardly facing horizontal slots 29. Between portions 27, are equally spaced downwardly projecting portions 28 which include vertical slots 30.

For assembly purposes, at least one of the pairs of cooperating slots in components 19,20,21 which receive a ball bearing, are open ended. In use, a ball bearing is located in each of the three slots 29 on the stationary support ring 19 which engage with slots 26 on the outer surface of rotating support ring 20. The interaction between the ball bearings and slots 26, 29 constrain relative vertical movement allowing the rotating support ring 20 to rotate (coaxially with stationary support ring 19) under action of lead screw 25. In the event of a failure of the lead screw actuator 22, the mounting ring 21 (and therefore the equivalent vessel supports 2) will not collapse or tip the cooking vessel. When in a fully extended position, the flat (horizontal) portions of sloped grooves 33, 34 ensure that collapse will not occur even if lead screw 25 failed. Further ball bearings are located in cooperating slots 34 and 33 on the rotating support ring 20 and mounting ring 21 respectively. The cooperating angled slots 33, 34 drive mounting ring 21 to translate axially as the rotating support ring 20 is rotated with respect to the mounting ring 21. The tendency of the mounting ring 21 to rotate about the central axis is prevented by a further steel ball bearing which interlocks into the stationary support ring 19 via each of three pairs of vertical slots 30,37.

Figure 6:
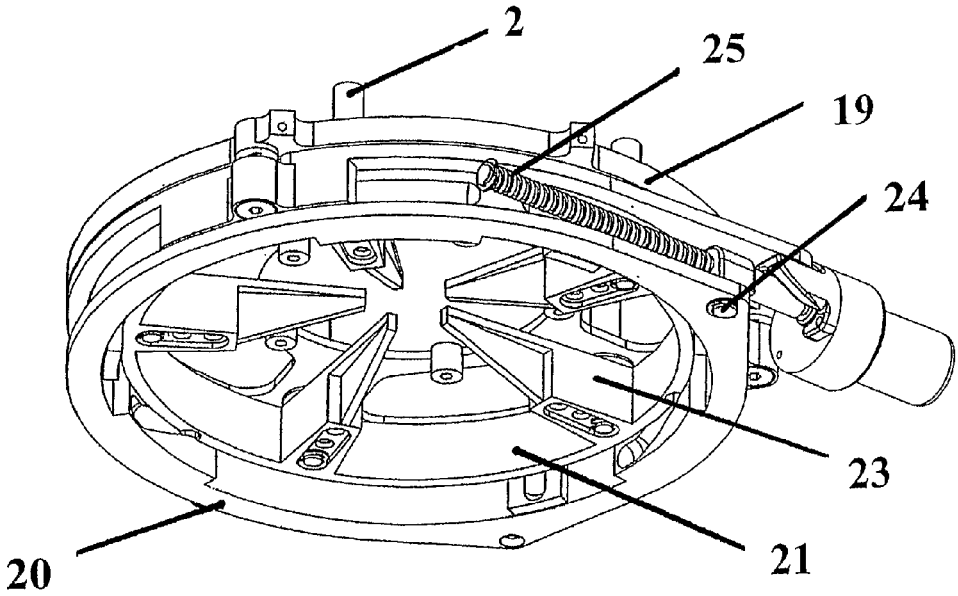
FIG. 6 is a perspective view of the underside of a ball cam lifting mechanism according to a further lifting embodiment shown with the cooking vessel supports extended.

The foregoing describes embodiments of lifter mechanisms which can be used to extend or retract burners and/or other moveable components. It will be appreciated that each embodiment is readily capable of use in conjunction with conventional gas burners (as shown in FIG. 1) or with the burner of another aspect of the present invention described later in relation to FIGS. 7 to 12 or 13 to 17. FIG. 6 also shows a similar lifter mechanism suitable for use with different types of burner. When used in conjunction with typical prior art burners it is envisaged that a length of flexible tubing be used to deliver fuel gas to the burner nozzle. However, preferably the burner nozzle does not move with respect to the burner body as the unit is extended or retracted.

It is also envisaged that other support structures may be desirable for supporting cooking vessels above the gas burner. For example, each burner may be fitted with a support ring, either closed or comprising partial annular segments, in place of the rod shaped vessel supports already described. In an extended position (first operating condition), the ring extends up from the horizontal cooktop surface to a preferred distance above the gas burner, substantially as previously described. The ring or partial rings are adapted to contact the surface of the cooking vessel at least three points to provide a stable support platform. It will be appreciated that upstand rings (either complete or partial) would also be suitable for curved bottom cooking vessels such as woks. It is envisaged in such a case, that the supporting ring may be extendably/retractably supported above the cooktop surface by more or less than three supports extending through apertures in the cooktop surface. In a retracted position, the upstand ring is preferably substantially flush with the cooking surface, as previously described. For this purpose, the support ring may be recessed into the cooktop surface. The ring may be supported by one or more supports which may be substantially the same as cooking vessel supports 2 previously disclosed. Alternatively, a support ring (or segments) may be fitted over vessel supports 2, if desired, as an accessory. Similarly it will be appreciated that driving (lifting) mechanisms such as those previously disclosed will be inherently suitable for these variations in cooking vessel supports.

In a further alternative embodiment, the position of the vessel supports may also be varied to any intermediate extended position between the first and second operating conditions in order to vary the height above the gas burner cap as desired. In a further alternative embodiment the cooking vessel supports 2 may include a third operating condition which is extended further (or closer) than the first operating condition. The purpose of this third operating condition is to accommodate a curved bottomed cooking vessel such as a wok. The extra (or reduced) extension above the normal flat bottomed cooking vessel height, allows the curved bottom cooking vessel to extend downwards to a position higher (or lower) than the contact surfaces of the vessel supports above the burner cap 3. This allows the bottom surface of a wok, for example, to be supported at a proper distance from the burner cap. Variation in the height of the support locations may also provide the capability of finer control of the cooking heat, e.g.: below the normal lowest heat setting of the burner, by changing the proximity of the cooking vessel to the burner cap.

Whether a manual, electro-mechanical, hydraulic or pneumatic actuating system is used, it is preferable that a fail safe mechanism is included so that in the event of a failure of the extending/retracting mechanism the cooking vessel is not tilted, which may result in the hazardous spilling of hot material.

It will be appreciated by those skilled in the art that the gas heating appliance of the present invention may be constructed from any suitable materials. For example, the cooktop surface may be ceramic glass, metal, or stone. Similarly the cooking vessel supports, lifting mechanisms and burner components can be constructed from combinations of ceramics, metal or other appropriate heat resistant materials.

With reference to FIGS. 7, 8 and 12 to 18, in another aspect the present invention provides a gas burner with a high effective turn-down ratio and/or improved heat output control. The burner of this aspect of the present invention reduces the clearance needed between the burner cap and the cooking vessel by forcing secondary air up from below with a fan and allowing the second phase of combustion to start close to the surface of the cooking vessel and close to the central axis of the burner. This increases the temperature difference between the combustion gases and the cooking vessel at the stage where heat transfer is taking place, which improves heat transfer. Further, the burner of the present invention may include a burner cap 3 which is moveable so it can retract into the cooktop surface 1 for easy cleaning as described in relation to other aspects of the present application discussed above.

Figure 13:
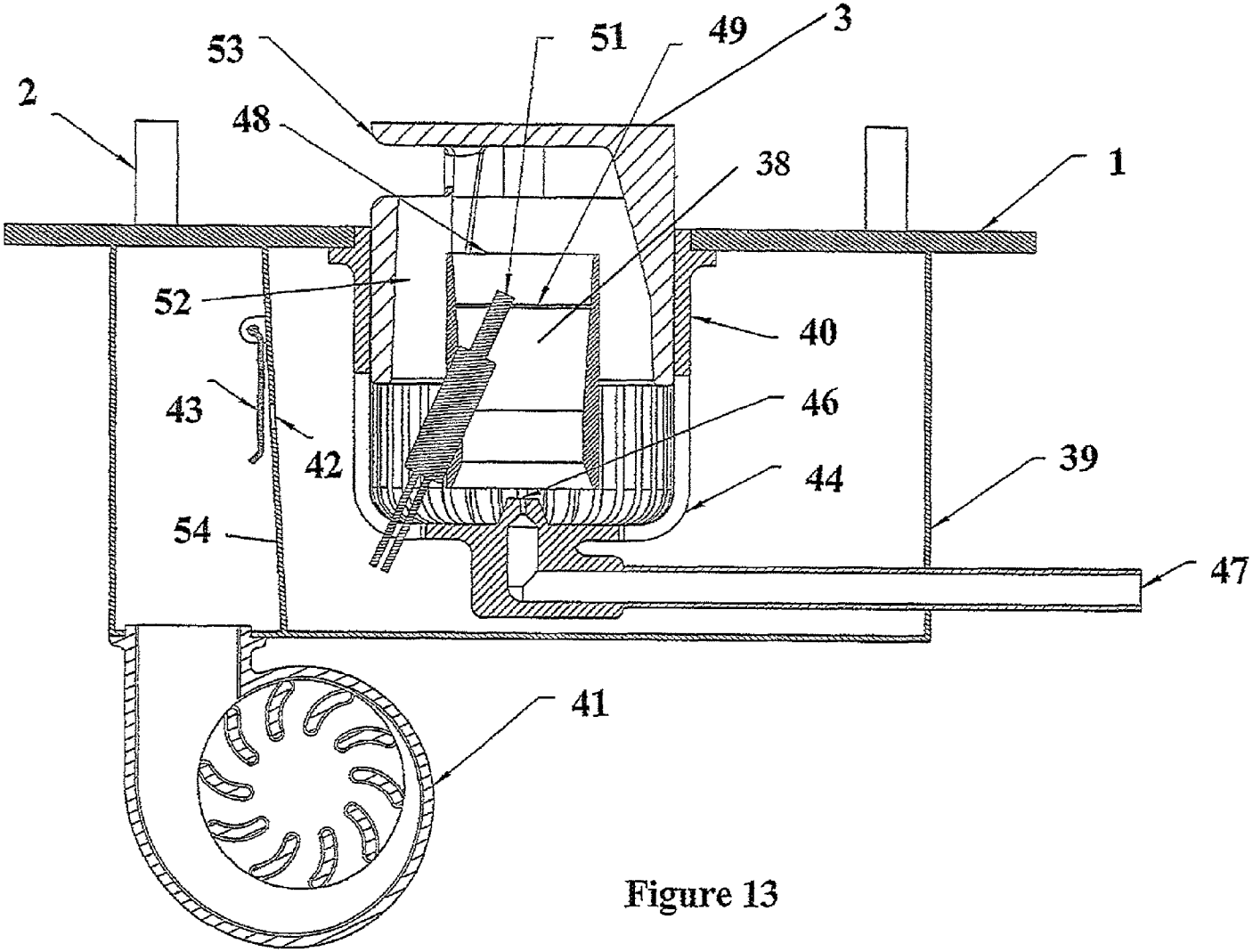
FIG. 13 is a cross sectional view of a burner according to an embodiment of the present invention.
Figure 14:
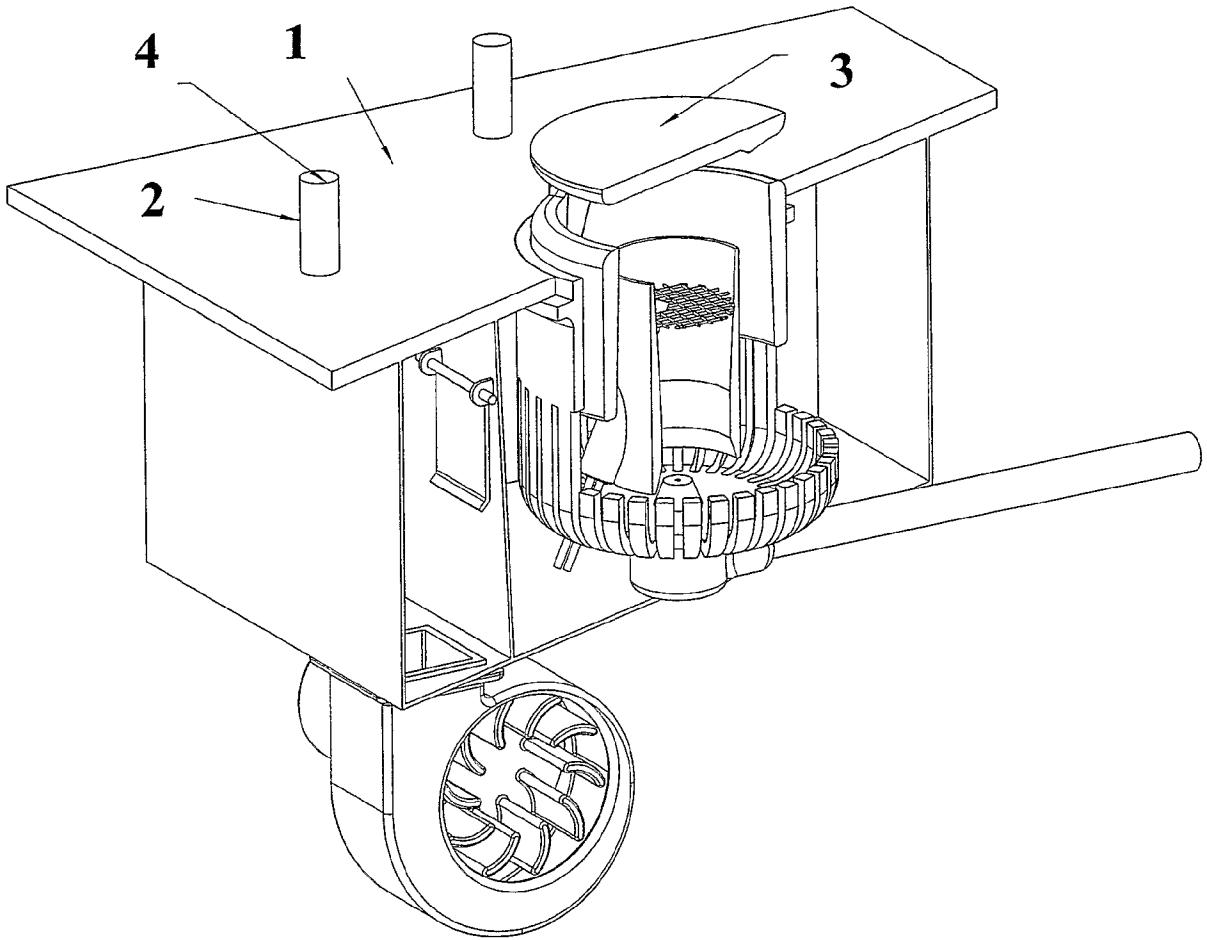
FIG. 14 is a partially cut away perspective view of the gas burner and cooktop of FIG. 13.
Figure 17:
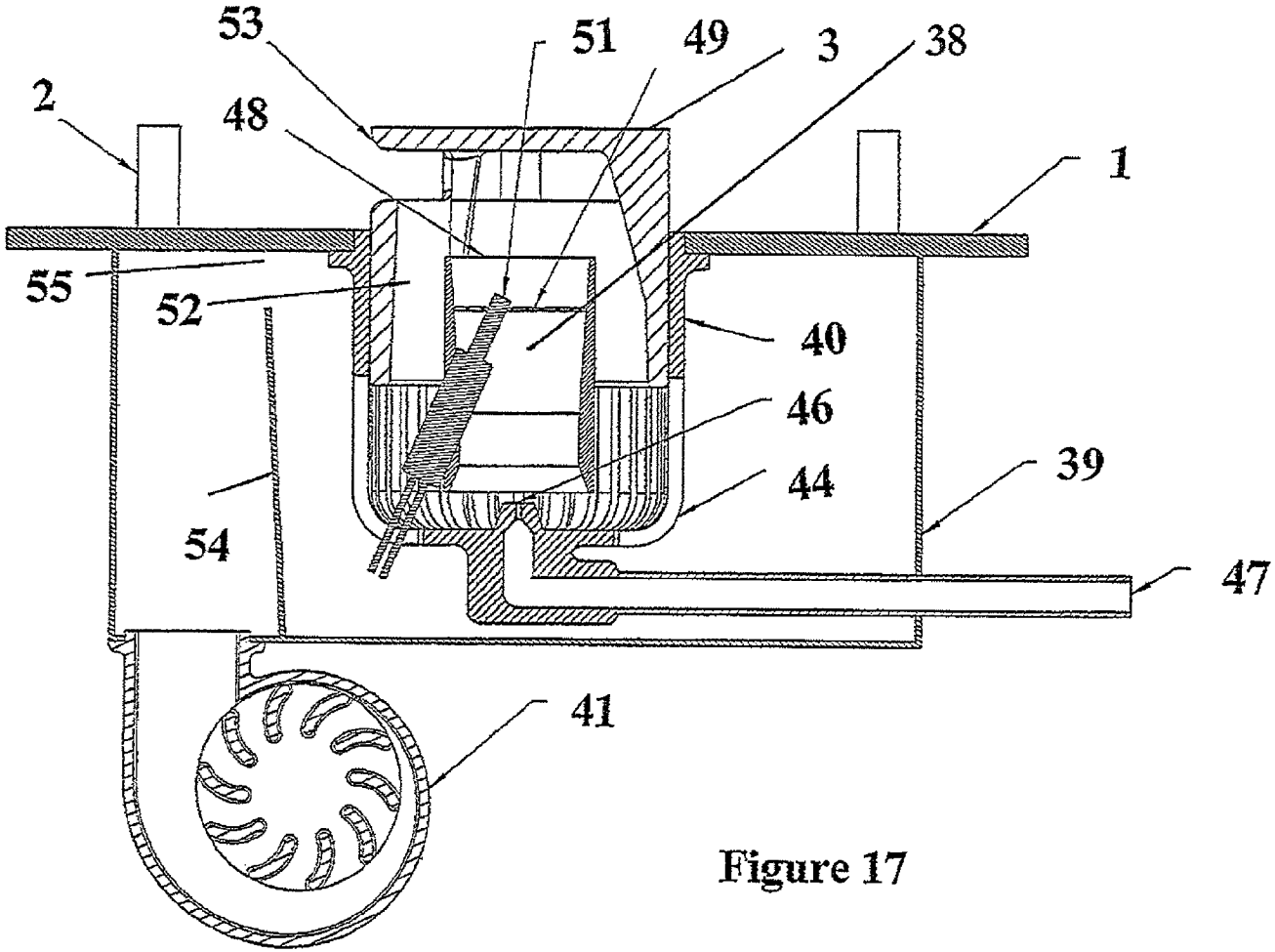
FIG. 17 is a cross sectional view of a burner according to a further preferred embodiment of the present invention.

With reference to FIG. 13 a gas heating appliance has a spill plane or planar cooktop surface 1 with a burner cap 3 therein. Beneath the cooktop surface 1 is a base pan or plenum chamber 39 which substantially surrounds the gas burner housing 40. The burner housing is supplied with air, via the appliance housing base pan 39, by one or more fans 41. The fan 41 may be any suitable type of fan, for example an axial, radial, centrifugal or positive displacement air pump type. Further, the fan or fans may operate at a constant speed or may be operable at variable speeds depending on the burner type and/or the burner settings, and/or the configuration of the burners within the cooktop. A single fan may also be utilized to supply multiple burners with air. Alternatively each burner, or groups of burners, may have their own fan or fans and respective base pan. It is also envisaged that the fan 41 may pump air into one or more intermediate chambers or plenums connected to each other, or connected to the appliance housing/base pan, or burner body, by restrictive orifices such as orifice 42. The restrictive orifices may comprise a single aperture or slot (for example running the full length of the baffle 54) or a series of apertures. The restrictive orifices 42 connecting the one or more intermediate chambers may also include excess flow valves or surge flaps 43, or diaphragms or a laminar flow device, in order to prevent the flame from being affected or extinguished by variation in the ambient conditions around the burner, for example opening or closing cupboards of a kitchen cabinet in which the gas appliance may be fitted. An alternative preferred arrangement is shown in FIG. 17. In this embodiment there is a baffle 54 between the fan chamber and the base pan 39. Air flow from the fan 41 enters the base pan 39 through gap 55 between the top of the baffle and the underside of the cooktop surface 1. The tortuous path has been found to result in adequately even air flow into the burner body.

Air is forced into the base of the burner body housing 40, optionally through a series of air induction orifices. The air induction orifices may be provided to help the airflow into the base portion of the burner housing 40 to be more evenly distributed. The air induction orifices (if present) are preferably evenly spaced slots 44, as shown in FIG. 13. Alternatively the air induction orifices may be holes or may be in the form of a wire mesh or the like. The slot shape of the air induction slots 44 allow the burner of the present invention to incorporate the extend and retract features described earlier, by allowing the supports for the burner cap 3 to translate through the slots. The lifting mechanism is fully located within the pressurised pressurized enclosure 39.

Figure 8:
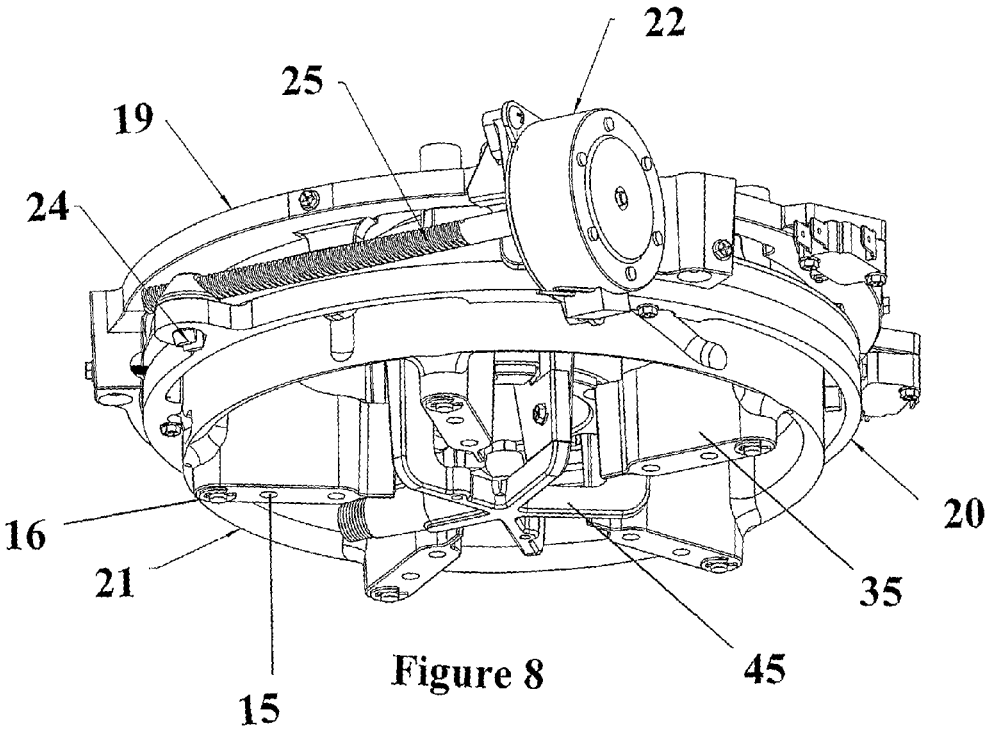
FIG. 8 is a perspective view of the underside of the mechanism of FIG. 7 showing the cooking vessel supports retracted.

The embodiment illustrated in FIGS. 7 and 8 show a gas burner of the present invention without the induction slots as shown in the embodiment of FIG. 13. However it can be seen how the mounting ring supports 35 are able to translate vertically between support ribs 45. Further, it is envisaged that the air flow entering the base of the burner may be modified by deflecting surfaces or vanes or an array of apertures, which may improve the efficiency and/or emissions of the burner, and/or may influence the ratio of fan forced air which flows through the inner and outer passages respectively.

At the base of the burner body 40, is a fuel gas jet 46 which is preferably located on, or about, the burner centre line, and directs the jet of fuel gas upwards. Fuel gas is delivered to the fuel gas jet nozzle or injector 46 by fuel gas inlet 47. The fuel gas flow rate in the fuel gas inlet 47, is controlled by a control valve (not shown) as is known in the art for varying the output of gas burners. A preferred method of controlling gas flow to each burner in accordance with user settings is with a rotary gas valve mechanically coupled to the rotor shaft of a stepper motor. User adjustments of flame height are received as electronic inputs to a microcontroller. The microcontroller can then control the stepper motor to drive the gas valve to the appropriate angular shaft position to correspond to user-selected flame height level. Software and a user interface display may also be included to aid with user friendliness of the control of the gas burner or burners.

The fuel gas exits the fuel gas jet 46 (or alternatively, two or more jets), and diverges into a substantially conical shape as it passes through a venturi tube 48, which is substantially aligned with the fuel gas jet axis (or axes). The venturi tube 48 is open at the top and the bottom, and shelters the diverging cone of gas exiting the fuel gas jet, from some of the fan forced (oxidizing) airflow. The tube 48 divides the burner into two first and second concentric gases passage ways 52, 38 respectively. The fuel gas and some entrained and fan forced air, which enters the tube 48 flows through the inner passage way 38. The majority of the fan forced oxidizing air flows in the outer passage 52 and is separated from the air fuel mixture flowing in the inner passage 38 by the tube walls.

Figure 20A:
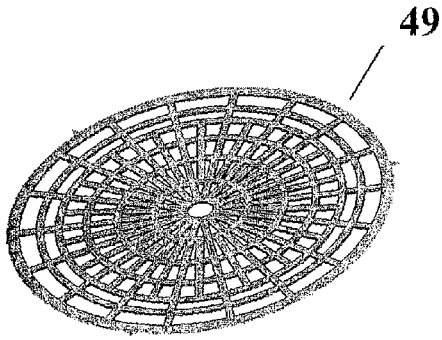
FIG. 20 is a perspective view of two further alternative preferred embodiments of flame front locator.
Figure 20B:
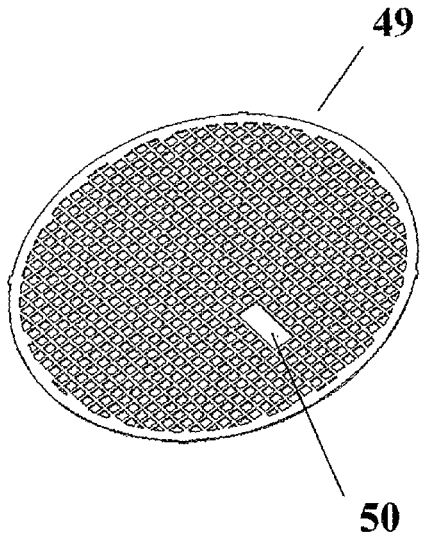

It is envisaged that the venturi tube 48 may contain means for locating and/or modifying the flame front. The flame front locators 49 are positioned within the venturi tube 48, to control the position of the flame and/or reduce the noise in the burner. The flame front locating structure fixes the starting point of the flame which would otherwise move considerably depending on the fuel gas flow rate and burn back velocity. This helps the flame to remain stable and also makes flame detection more reliable. The flame front locator spreads the flame front and slows the gases helping mix with air and makes the flame reaction less noisy. It is envisaged that the means for locating the flame may be any of a variety of structures. For example, a number of elements may be arranged across the venturi opening in a parallel structure or alternatively may be radially oriented like spokes and may also contain apertures in the spoke arrangement. It has also been found that a simple wire mesh works very effectively as the preferred flame locating means. With reference to FIGS. 20*a* & 20*b*, two preferred embodiments of flame front locator are shown. In FIG. 20*b*, slot 50 is provided to accommodate the tip of a hot surface igniter. The flame front locators shown in FIGS. 20*a* and 20*b* are formed from a thin flat metal disc, and may be manufactured by any suitable method such as punching, chemically etching, laser cutting or spark erosion.

The venturi 48 preferably also contains elements for ignition 51 such as hot surface igniters and/or electrodes for spark ignition and/or flame detection, all well known in the art of gas burners.

The venturi tube 48 is designed to provide entrainment of primary air at higher power settings. At lower power settings, primary and secondary air is provided by the small portion of fan forced air that flows through passage 38 of venturi tube 48. Alternatively, the tube 48 may be a straight walled cylindrical tube which functions primarily to separate the gas flow into two concentric passages 38, 52 and shelter the inner passage 38 from some of the fan forced air. Alternatively, a further smaller venturi tube may be positioned in close proximity to the jet to improve primary air entrainment at lower power settings.

Figure 15:
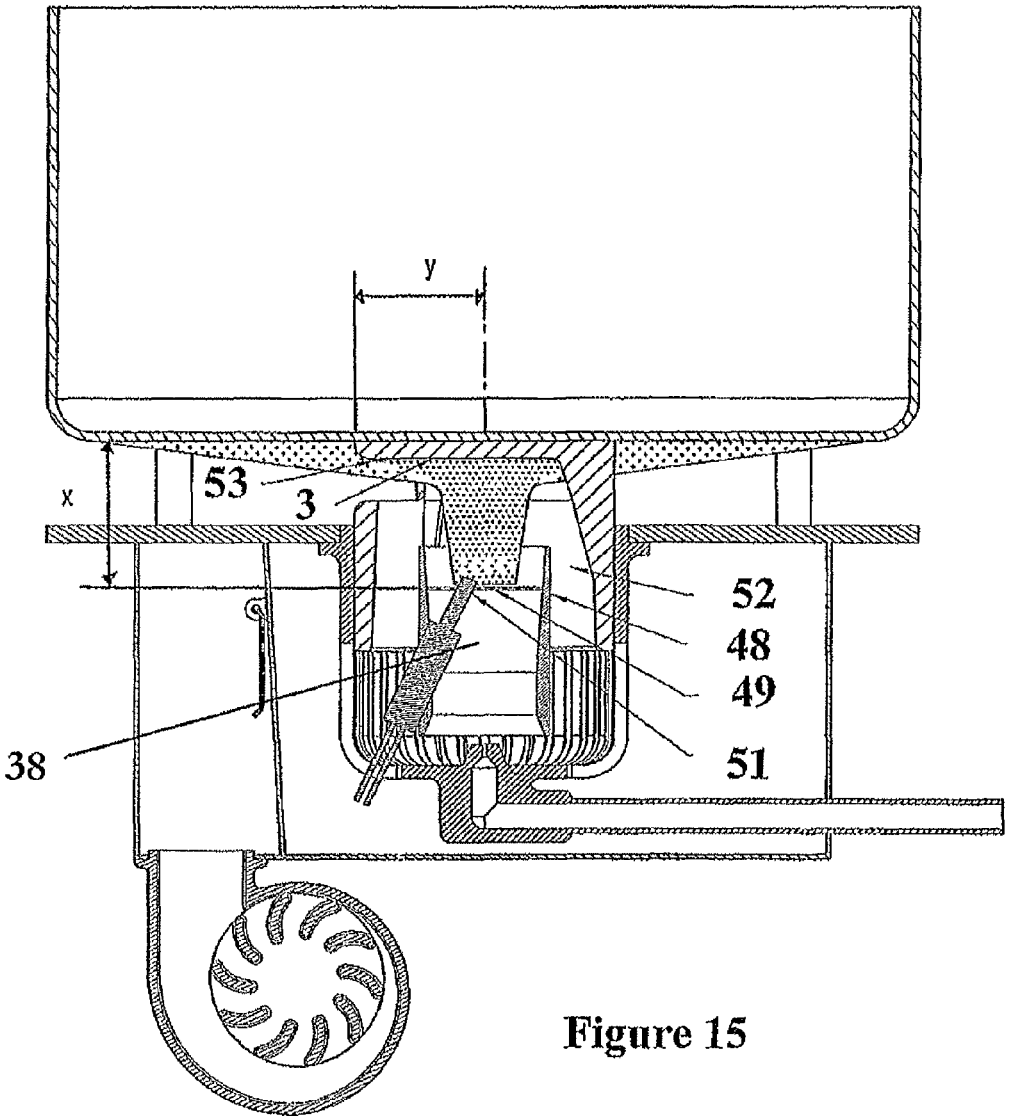
FIG. 15 is a schematic view of a gas burner according to an embodiment of the present invention shown with the flame at a high power setting.
Figure 16:
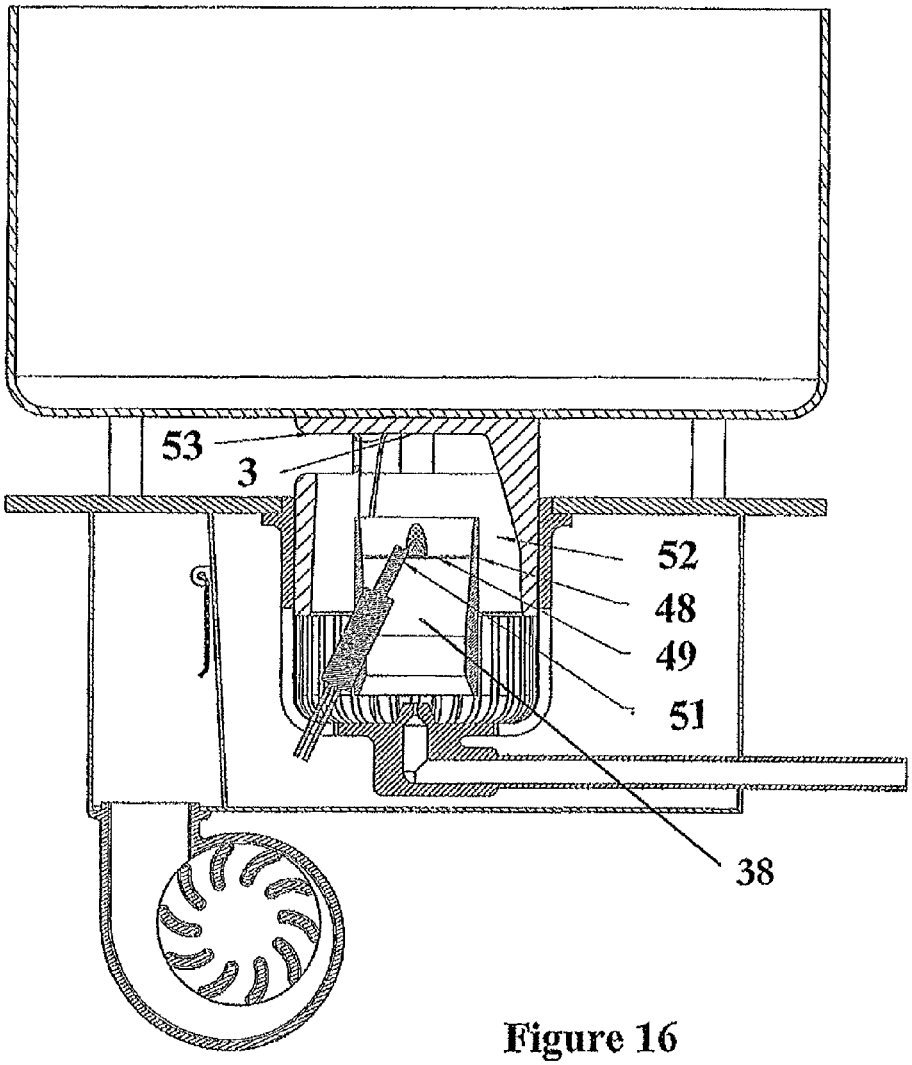
FIG. 16 is a schematic view of a gas burner according to an embodiment of the present invention shown with the flame at a low power setting.

In use at high power settings, primary combustion air is drawn up through the venturi passage 38 predominately by entrainment with the fuel gas flow. The flame front occurs within the venturi tube 48 at a point where the fuel gas cone has spread and mixed with the primary air enough that the mixture is combustible and may be located by flame front locating means 49, as shown in FIG. 15. The primary flame travels up through the burner body 40, diverging before impinging on the under surface of the burner cap 3 (shown approximately as fine array of shading dots). The underside of the burner cap 3 may be substantially flat or angled (or curved) such that it directs the primary flame substantially radially outwards, which mixes with the fan forced secondary air flowing upwards in the annular gap forming passage 52 between the venturi tube 48 and the burner body 40. The factors of cap diameter (y), distance of cap from flame locators (x), and air/fuel gas flow rates, all affect the position at which secondary combustion occurs at higher power. At higher powers, it is preferable for secondary combustion (shown in FIG. 15 approximately as coarse array of shading dots) to commence on or about the lower circumferential edge 53 of the burner cap 3. The fan forced secondary air flowing through passage 52 eliminates the need for the flame to draw all secondary air from the ambient surroundings in order to achieve substantially complete combustion. Therefore, the burner cap 3 can be quite dose to, or in contact with, the base of the cooking vessel which allows for improved heat transfer to the cooking vessel due to the proximity of the cooking vessel to the high heat output phase of the flame reaction.

It has been found that efficiency is improved by a relatively small diameter of the burner cap 3, as it forces the hot gases to flow radially outwards over an extended distance across the bottom of the cooking vessel. Efficiency is also improved by the relatively high temperature difference between the flowing gases and the surface of the cooking vessel. Further, the secondary combustion which is allowed by the supply of fan forced secondary air, causes the secondary combustion to occur in a concentrated area thereby extending the distance over which the hot gases are in contact with the bottom of the cooking vessel.

At lower power settings, the combustion air is predominately provided as forced air from the fan 41 flowing through the passage 38 of tube 48. When the burner is turned down to lower levels, the flame recedes first diametrically and then downwards into the venturi tube 48 where the air flow is sufficient for complete combustion at low power settings (flame shown approximately in FIG. 16). The venturi tube 48 shelters the smaller flame from the ambient air flow and from the fan forced air flow flowing in passage 52. This sheltering of the smaller flame is preferable to prevent the smaller flame from being extinguished. This may allow the use of a constant speed fan if desired. Alternatively, a variable speed fan (which may be controlled according to burner power settings or combined burner power settings) may be utilized and thereby reduce the amount of sheltering of the low power flame necessary. When the burner is at these lower settings, the fan forced air flowing through passage 52 mixes with the combustion gases exiting the passage 38, thereby cooling them and resulting in a lower heat transfer to the cooking vessel, which contributes to the relatively high effective heating range (large effective turn down ration) of the gas burner.

Due to the relatively high turn down ratios which are achievable by burners of the present invention, it may not be necessary to produce a large number of varying burner sizes in order to achieve desirable maximum and minimum outputs. For example, it may be preferable to produce two burner sizes having respective maximum outputs of approximately 2.5 kilowatts and 6 kilowatts. The effective high turn down ratio that is achievable with the burner design (the inventors have achieved effective ratios of approximately 50:1, and better in experiments) allows for a great deal of flexibility in output range for burners in a cooktop gas heating appliance.

Figure 18:
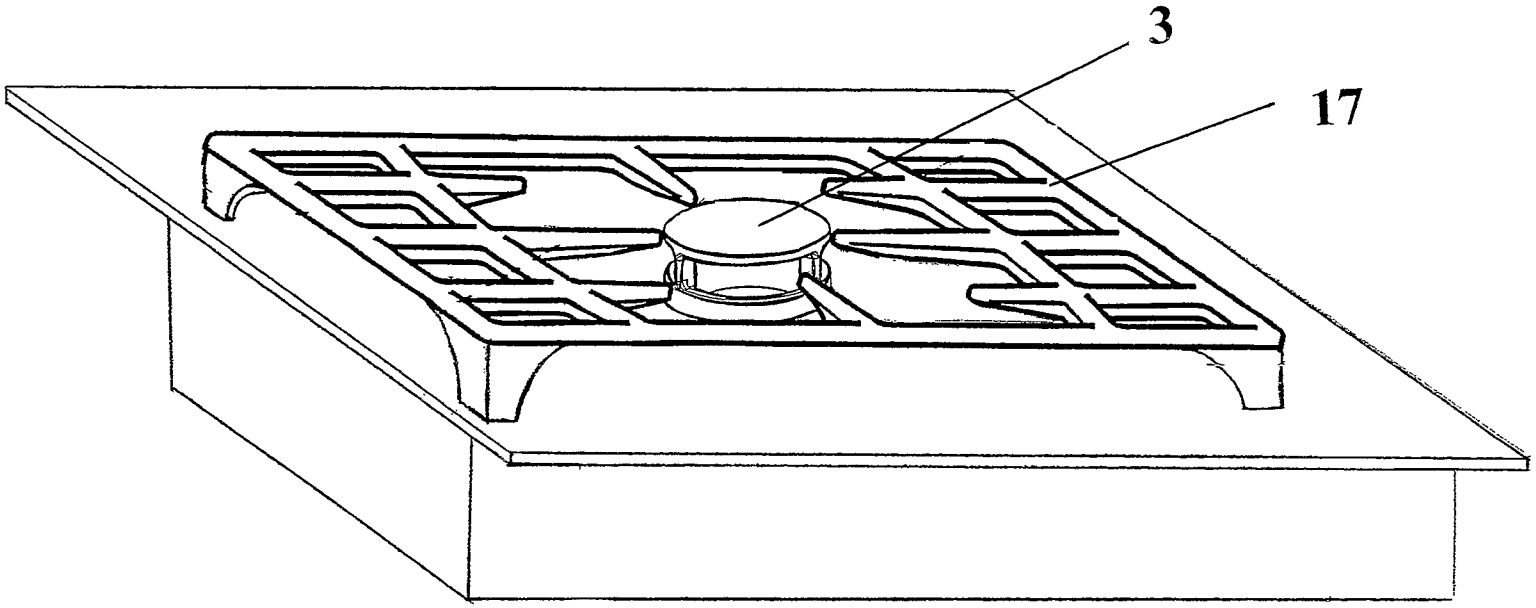
FIG. 18 is a perspective view of a burner according to a preferred embodiment of the present invention located in a traditional cooktop surface with a traditional trivet for supporting a cooking vessel.

The burner according to the present invention is also suitable for use with conventional type gas cooktops as shown in FIG. 18, where a conventional trivet 17 is provided and the burner cap is not retractable. Alternatively, the burner according to the present invention may be especially suited to gas cooktops which include retractable burner caps as described earlier.

To those skilled in the art to which the invention relates, many changes in construction and widely differing embodiments and applications of the invention will suggest themselves without departing from the scope of the invention as set out in this specification. The disclosures and description herein are purely illustrative and are not intended to be in any sense limiting.

The invention claimed is:

1. A gas burner for a cooking appliance comprising:

a first gases flow passage including an inlet and an outlet, a second gases flow passage including an inlet and an outlet, gases flowing through said outlet of said second gases flow passage flowing in an outlet direction, at least one fuel gas jet configured to supply fuel to said second gases flow passage, a source of oxidizing gases at said inlet of said first gases flow passage, a source of oxidizing gases at said inlet of said second gases flow passage, a flame locator within said second gases flow passage, and spaced upstream from said outlet of said second gases flow passage, and spaced downstream of said inlet of said second gases flow passage, said spacing upstream from said outlet of said second gases flow passage sufficient to shelter a flame, when said burner is at a low power setting, and to prevent the flame from being extinguished by said oxidizing gases in said first gases flow passage, and said outlet of said first gases flow passage proximate to said outlet of said second gases flow passage, and a moveable burner cap extending transversely to said outlet direction of said second gases flow passage, said cap having a first extended operating condition and a second retracted non-operating condition, wherein with said burner cap in said first extended operating condition, said burner cap is spaced downstream from said outlet of said first gases flow passage, and with said burner cap in said second retracted non-operating condition, said burner cap substantially closes said outlet of said first gases flow passage.

2. A gas burner as claimed in claim 1, wherein said inlet of said first gases flow passage and said inlet of said second gases flow passage are in fluid communication with at least one pressurized gases supply.

3. A gas burner as claimed in claim 2, wherein the minority of pressurized gases from said pressurized gases supply flows through said second gases flow passage.

4. A gas burner as claimed in claim 2, wherein said pressurized gases supply is provided by at least one constant speed fan.

5. A gas burner as claimed in claim 3, wherein said pressurized gases supply is at least one variable speed fan.

6. A gas burner as claimed in claim 3, wherein said burner includes a plenum chamber receiving air from a pressurized gases supply and a burner body having at least an annular end portion projecting into said plenum chamber with an annular air inlet receiving air from said plenum chamber, said burner body being divided into said first gases flow passage and said second gases flow passage.

7. A gas burner as claimed in claim 6, wherein said body is divided by a vertically oriented cylindrical tube mounted concentrically within said body, with a lower open end of the tube spaced from the floor of said chamber above said fuel jet.

8. A gas burner as claimed in claim 2, wherein said outlet of said second gases flow passage is located substantially within said first gases flow passage and said outlet of said second gases flow passage is in fluid communication with said outlet of said first gases flow passage.

9. A gas burner as claimed in claim 7, wherein said fuel gas jet is spaced from said inlet of said second gases flow passage, and said jet is in fluid communication with said inlet of said second gases flow passage.

10. A gas burner as claimed in claim 9, wherein said first gases flow passage is partially closed, at an inlet end, and said inlet of said first gases flow passage comprises of a plurality of apertures at said inlet end of said first gases flow passage.

11. A gas burner as claimed in claim 10, wherein said apertures are radially spaced slots extending axially with respect to said first gases flow passage.

12. A gas burner as claimed in claim 9, wherein said second gases flow passage is located concentrically within said first gases flow passage.

13. A gas burner as claimed in any one of claims 1 to 7 and 8 to 12, wherein said burner is located in a horizontal cooking surface having at least one aperture, and said burner cap fits said aperture in said cooking surface and is movable between a position wherein the top surface of said cap is at least substantially flush with said cooking surface and a position wherein said cap is displaced from said cooking surface to leave an annular opening to said outlet of said first gases flow passage.

14. A domestic gas heating appliance comprising a planar cooking surface, a user interface, and at least one burner as claimed in claim 1.

15. A gas burner for a cooking appliance comprising:

a first gases flow passage including an inlet and an outlet, a second gases flow passage including an inlet and an outlet, gases flowing through said outlet of said second gases flow passage flowing in an outlet direction, at least one fuel gas jet configured to supply fuel to said second gases flow passage, a source of oxidizing gases at said inlet of said first gases flow passage, a source of oxidizing gases at said inlet of said second gases flow passage, a flame locator within said second gases flow passage, and spaced upstream from said outlet of said second gases flow passage, and spaced downstream of said inlet of said second gases flow passage, said spacing upstream from said outlet of said second gases flow passage sufficient to shelter a flame, when said burner is at a low power setting, and to prevent the flame from being extinguished by said oxidizing gases in said first passage, and said outlet of said first gases flow passage proximate to said outlet of said second gases flow passage, and a burner cap spaced downstream from said outlet of said second gases flow passage, said burner cap extending transversely to said outlet direction of said second gases flow passage, said burner being located in a horizontal cooking surface having at least one aperture, and said burner cap fits said aperture in said cooking surface and is movable between a position wherein the top surface of said cap is at least substantially flush with said cooking surface and a position wherein said cap is displaced from said cooking surface to leave an annular opening to said outlet of said first gases flow passage.

16. A gas burner as claimed in claim 15, wherein said inlet of said first gases flow passage and said inlet of said second gases flow passage are in fluid communication with at least one pressurized gases supply.

17. A gas burner as claimed in claim 15, wherein the minority of pressurized gases from said pressurized gases supply flows through said second gases flow passage.

18. A gas burner as claimed in claim 17, wherein said pressurized gases supply is provided by at least one constant speed fan.

19. A gas burner as claimed in claim 18, wherein said pressurized gases supply is at least one variable speed fan.

20. A gas burner as claimed in claim 18, wherein said burner includes a plenum chamber receiving air from a pressurized gases supply and a burner body having at least an annular end portion projecting into said plenum chamber with an annular air inlet receiving air from said plenum chamber, said burner body being divided into said first gases flow passage and said second gases flow passage.

21. A gas burner as claimed in claim 20, wherein said body is divided by a vertically oriented cylindrical tube mounted concentrically within said body, with a lower open end of the tube spaced from the floor of said chamber above said fuel jet.

22. A gas burner as claimed in claim 21, wherein said fuel gas jet is spaced from said inlet of said second gases flow passage, and said jet is in fluid communication with said inlet of said second gases flow passage.

23. A gas burner as claimed in claim 22, wherein said first gases flow passage is partially closed, at an inlet end, and said inlet of said first gases flow passage comprises of a plurality of apertures at said inlet end of said first gases flow passage.

24. A gas burner as claimed in claim 23, wherein said apertures are radially spaced slots extending axially with respect to said first gases flow passage.

25. A gas burner as claimed in claim 22, wherein said second gases flow passage is located concentrically within said first gases flow passage.

26. A gas burner as claimed in claim 16, wherein said outlet of said second gases flow passage is located substantially within said first gases flow passage and said outlet of said second gases flow passage is in fluid communication with said outlet of said first gases flow passage.

27. A domestic gas heating appliance comprising a planar cooking surface, a user interface, and at least one burner as claimed in claim 15.

* * * * *